US008106866B2

(12) United States Patent
Wang

(10) Patent No.: US 8,106,866 B2
(45) Date of Patent: Jan. 31, 2012

(54) METHOD FOR ESTABLISHING GAMMA CORRECTION TABLE FOR LIQUID CRYSTAL DISPLAY

(75) Inventor: Jian-Feng Wang, Shenzhen (CN)

(73) Assignees: Innocom Technology (Shenzhen) Co., Ltd., Shenzhen, Guangdong Province (CN); Chimei Innolux Corporation, Miao-Li County (TW)

( * ) Notice: Subject to any disclaimer, the term of this patent is extended or adjusted under 35 U.S.C. 154(b) by 1039 days.

(21) Appl. No.: 12/011,667

(22) Filed: Jan. 28, 2008

(65) Prior Publication Data

US 2008/0180375 A1 Jul. 31, 2008

(30) Foreign Application Priority Data

Jan. 26, 2007 (CN) ..... 2007 1 0073127

(51) Int. Cl.
*G09G 3/36* (2006.01)
*G09G 5/02* (2006.01)

(52) U.S. Cl. ..... 345/89; 345/690

(58) Field of Classification Search ..... 345/690, 345/89, 590, 88, 102
See application file for complete search history.

(56) References Cited

U.S. PATENT DOCUMENTS 4,788,598 A * 11/1988 Ochi et al. ..... 358/3.01
6,879,310 B2 * 4/2005 Nose ..... 345/88
7,030,846 B2 4/2006 Lee et al.
7,095,395 B2 * 8/2006 Bu ..... 345/89
7,181,088 B2 2/2007 Lin
7,746,304 B2 * 6/2010 Lee et al. ..... 345/89
2006/0146066 A1 * 7/2006 Sasaki ..... 345/590
2006/0238551 A1 * 10/2006 Dalal ..... 345/690
2007/0115232 A1 * 5/2007 Urisu ..... 345/88
2007/0152949 A1 * 7/2007 Sakai ..... 345/102

FOREIGN PATENT DOCUMENTS

CN 1209906 C 7/2005
TW 564645 B 12/2003

* cited by examiner

*Primary Examiner* — Chanh Nguyen
*Assistant Examiner* — James Nokham
(74) *Attorney, Agent, or Firm* — Altis Law Group, Inc.

(57) ABSTRACT

An exemplary method for establishing a gamma correction table for a liquid crystal display includes: providing a liquid crystal display, a signal generator, and a color analyzer, the liquid crystal display comprising a predetermined gamma correction table; invalidating a predetermined gamma correction table of the liquid crystal display; initializing the liquid crystal display, the signal generator, and the color analyzer; measuring $2^n$ (n is a natural number) reference gray scales of a single-colored image; obtaining a single-colored correction curve relating to luminance values corresponding the reference gray scales; obtaining an ideal single-colored gamma curve; storing 256 gray scales corresponding to the luminance values that most close to the luminance values of gray scale 0 to gray scale 255; and establishing a gamma correction table.

17 Claims, 3 Drawing Sheets

METHOD FOR ESTABLISHING GAMMA CORRECTION TABLE FOR LIQUID CRYSTAL DISPLAY

FIELD OF THE INVENTION

The present invention relates to a method for establishing a gamma correction table for a liquid crystal display (LCD).

BACKGROUND

LCDs are commonly used as display devices for compact electronic apparatuses. Typical LCDs not only provide good quality images with little power consumption, but also are very thin. In general, an LCD includes a liquid crystal panel and a backlight module for illuminating the liquid crystal panel.

The LCD panel needs to be driven by gamma voltages in order to display images. The gamma voltages are provided by an external apparatus. Each gray scale of the images displayed by the LCD panel corresponds to a gamma voltage signal.

The LCD usually further includes a gamma circuit having a gamma correction table for correcting the gamma voltage signals according to a predetermined gamma parameter $\gamma$. The gamma parameter $\gamma$ can be, for example, 2.2. The correction process is generally based on a formula $Y=A*X^{\gamma}$ (where A is a constant, X represents a gamma voltage signal, and Y represents a corresponding gray scale). The correction table includes the gamma voltage signals and the corresponding gray scales. However, because different mass manufactured LCDs inevitably have inherent differences, the gamma parameter $\gamma$ that is preset for a particular LCD model may not be apt for every individual LCD in the batch of LCDs manufactured. That is, for different LCDs in the batch, the actual gray scales displayed may not be the best possible gray scales that can achieve optimum display of images. Thus the gamma correction table may be unable to achieve its intended function in some of these LCDs.

What is needed, therefore, is a method for establishing a gamma correction table for a liquid crystal display which can overcome the above-described deficiencies.

SUMMARY

An exemplary method for establishing a gamma correction table for a liquid crystal display includes: providing a liquid crystal display, a signal generator, and a color analyzer, the liquid crystal display comprising a predetermined gamma correction table; invalidating the predetermined gamma correction table of the liquid crystal display; initializing the liquid crystal display, the signal generator, and the color analyzer; measuring $2^n$ (n is a natural number) reference gray scales of a single-colored image displayed by the liquid crystal display; obtaining a single-colored correction curve relating to luminance values corresponding the reference gray scales; obtaining an ideal single-colored gamma curve; storing 256 gray scales corresponding to the luminance values that are closest to the luminance values of the gray scale 0 through the gray scale 255; establishing a single-colored gamma correction table for the single color; and establishing a gamma correction table based on the single-color gamma correction table.

Other novel features and advantages will become apparent from the following detailed description of preferred and exemplary embodiments when taken in conjunction with the accompanying drawings.

DETAILED DESCRIPTION OF PREFERRED EMBODIMENTS

Reference will now be made to the drawings to describe preferred and exemplary embodiments in detail.

Figure 1:
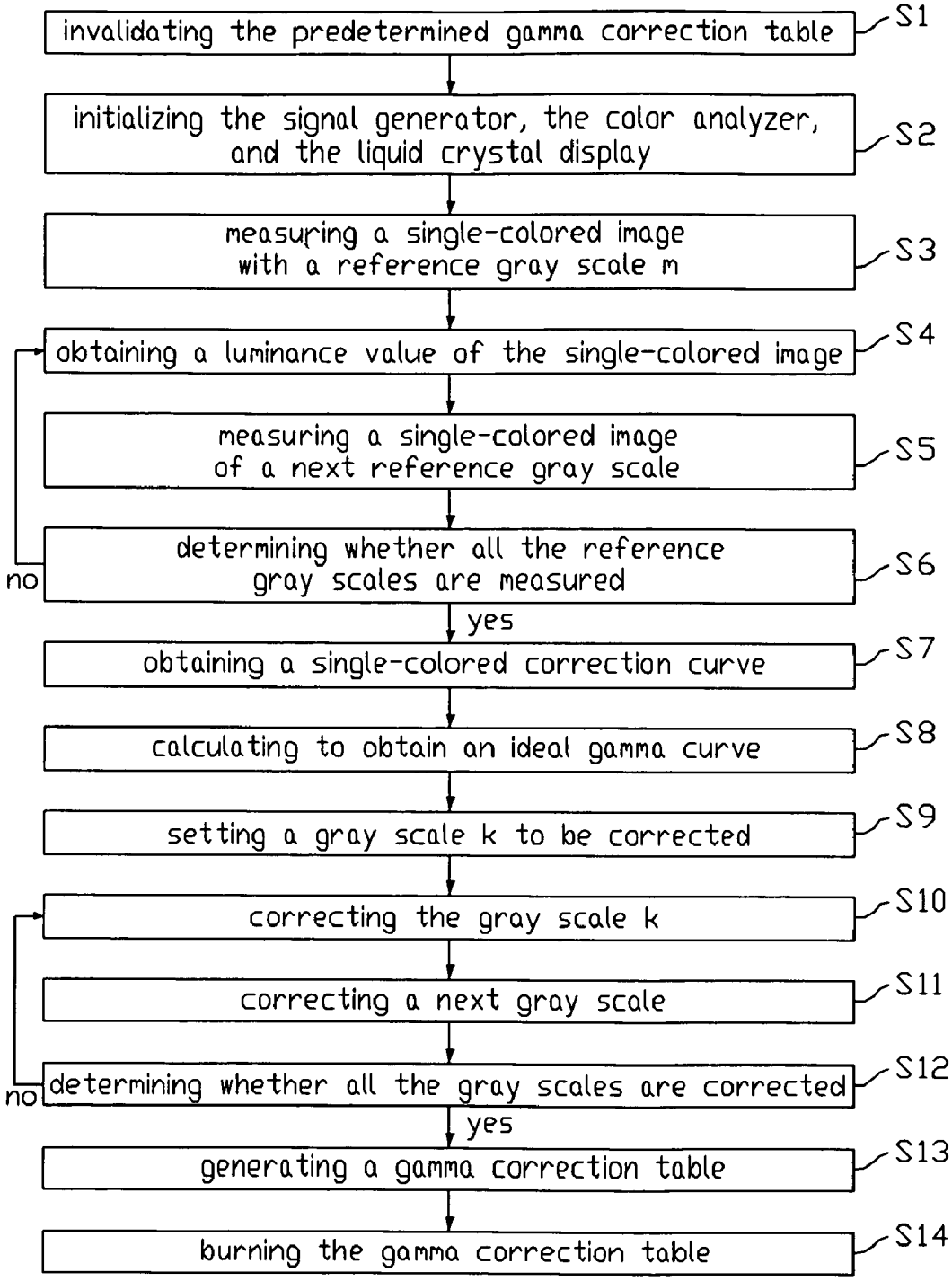
FIG. 1 is a flowchart summarizing a method for establishing a gamma correction table for a liquid crystal display according to an exemplary embodiment of the present invention.

Referring to FIG. 1, this is a flowchart summarizing an exemplary method for establishing a gamma correction table for a liquid crystal display. A signal generator and a color analyzer are respectively connected to the liquid crystal display. The liquid crystal display includes a memory configured for storing a predetermined (preset) gamma correction table. The signal generator is configured for providing a plurality of gamma voltage signals sequentially to the liquid crystal display, and includes a register for storing different luminance values corresponding to the gamma voltage signals. The color analyzer is configured for obtaining different luminance values corresponding to the gamma voltage signals from the liquid crystal display, and sending the luminance values to the signal generator.

The method includes: step S1, invalidating the predetermined gamma correction table; step S2, initializing the signal generator, the color analyzer, and the liquid crystal display; step S3, measuring a single-colored image with a reference gray scale m (where m is a whole number, $0 \leqq m \leqq 63$); step S4, obtaining a luminance value of the single-colored image; step S5, measuring a single-colored image of a next reference gray scale; step S6, determining whether all the reference gray scales are measured; step S7, obtaining a single-colored correction curve; step S8, calculating to obtain an ideal gamma curve; step S9, setting a gray scale k (where k is a whole number, $0 \leqq k \leqq 255$) to be corrected; step S10, correcting the gray scale k; step S11, correcting a next gray scale; step S12, determining whether all the gray scales are corrected; step S13, generating a gamma correction table; and step S14, burning the gamma correction table into the memory of the liquid crystal display.

In step S1, the predetermined gamma correction table stored in the memory of the liquid crystal display is invalidated by an exterior circuit or an appropriate item of software. During this process, the predetermined gamma correction table is not accessible to a main driving circuit of the liquid crystal display, in order that the predetermined gamma correction table can be temporarily invalidated.

In step S2, the signal generator, the color analyzer, and the liquid crystal display are initialized. The signal generator then provides the gamma voltage signals corresponding to a reference gray scale 0 through a reference gray scale 63 of a single selected color, respectively. In this embodiment, the selected color is the color red. The reference gray scale 0 through the reference gray scale 63 respectively correspond to the gray scale 0, the gray scale 4, the gray scale 8, . . . the gray scale 248, and the gray scale 252 of the liquid crystal display. The gamma voltage signals are sequentially applied to the liquid crystal display.

In step S3, a single-colored image of the liquid crystal display with the reference gray scale m, where m is beyond the range of the reference gray scale 0 through the reference gray scale 63, is measured. Such reference gray scale m is referred to herein as m(beyond). In this embodiment, the signal generator generates the gamma voltage signal corresponding to the reference gray scale m(beyond) of the color red, and the liquid crystal display displays an image of the reference gray scale m(beyond) of the color red according to the gamma voltage signal.

In step S4, a luminance value of the single-colored (i.e., red) image corresponding to the displayed image is obtained by the color analyzer. Because the red image needs some time to be displayed, a delay (usually one second) is applied for obtaining the luminance value. The luminance value is then transferred to the register of the signal generator.

In step S5, a next single-colored image of a reference gray scale (m+1) is measured. The signal generator generates the gamma voltage signal corresponding to the reference gray scale (m+1). The liquid crystal display displays a single-colored (i.e., red) image of the reference gray scale (m+1) according to the gamma voltage signal.

In step S6, a human operator determines whether the single-colored (i.e., red) images of all the reference gray scales have been measured by the color analyzer. If the number of luminance values stored in the register of the signal generator is in excess of 64, the process of measurement by the color analyzer is finished, and the procedure goes to step S7. If the number of luminance values stored in the register of the signal generator is not in excess of 64, the process of measurement is not finished, and the color analyzer carries on measuring the relevant reference gray scales; that is, the procedure goes back to step S4.

Figure 2:
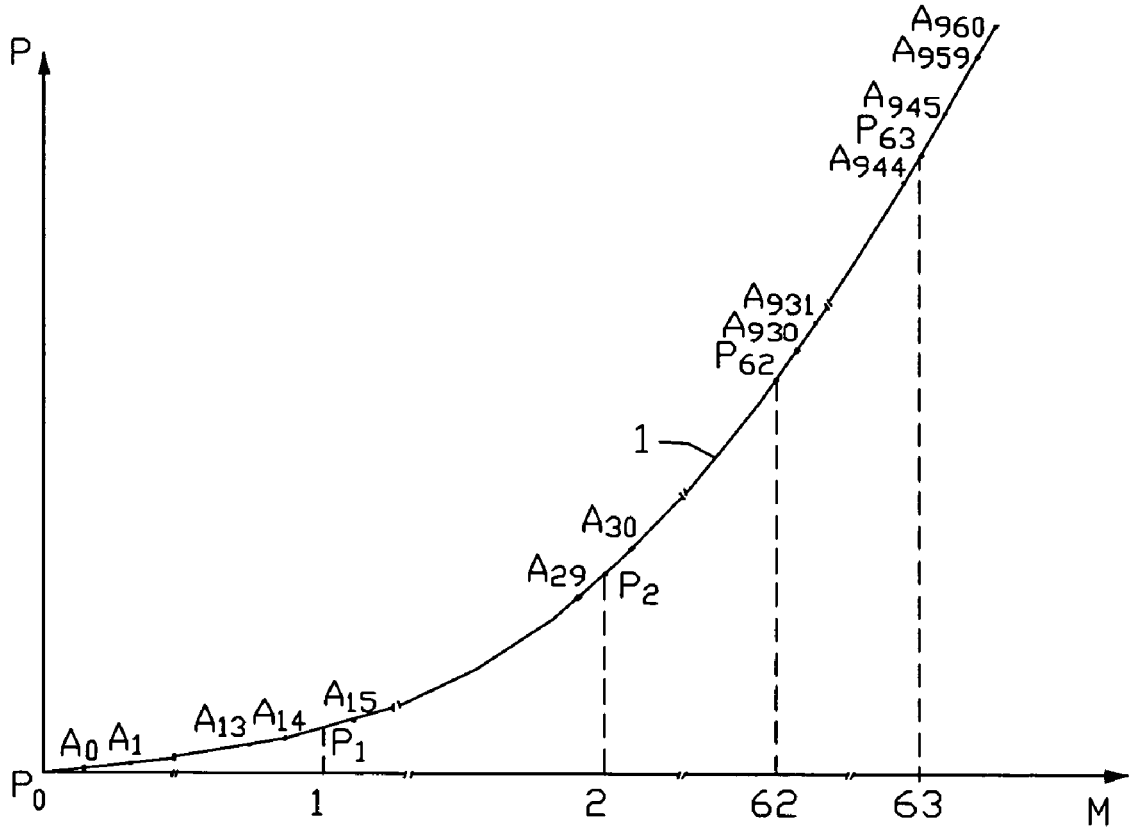
FIG. 2 is a graph illustrating a relationship between reference gray scales (X-axis) and corresponding luminance values (Y-axis), showing generation of a red correction curve in accordance with the method of claim 1.

In step S7, referring also to FIG. 2, a single-colored correction curve is obtained. In this embodiment, a red correction curve 1 is obtained. In detail, the red correction curve 1 is obtained according to an arithmetic interpolating method. Horizontal coordinate values M of the red correction curve 1 represent different reference gray scales from 0 to 63 and beyond. Vertical coordinate values P of the red correction curve 1 represent different luminance values corresponding to the reference gray scales from 0 to 63 and beyond. In particular, 64 points P0 to P63 represent 64 different luminance values corresponding to the reference gray scales from 0 to 63. A line between the point P0 and the point P1 is divided into 16 equal parts by 15 points A0 through A14. Similarly, a line between the point P1 and the point P2 is divided into 16 equal parts by 15 points A15 through A29. Each line between every two successive points Pi and P(i+1) is divided into 16 equal parts by 15 points A(15*i*) through A(15*i*+14), where i is a whole number, and 0≦i≦62. Thus along the line between the point P62 and the point P63, 15 points A930 through A944 divide the line into 16 equal parts. Beyond the point P63, 16 further points A945 through A960 are arranged sequentially, such that there are 16 equal parts between the point P63 and the point A960. The 16 equal parts between the point P63 and the point A960 have the same length as the 16 equal parts between the points A930 through A944. Accordingly, there are a total of 1024 points, being the points A0 through A960 and the points P0 through P63. By connecting the 1024 points sequentially, the red correction curve 1 is obtained.

In step S8, an ideal gamma curve 2 is obtained. A maximum luminance value Lmax corresponding to the gray scale 255 of the red images displayed by the liquid crystal display is measured by the color analyzer. A minimum luminance value Lmin corresponding to the gray scale 0 of the red images displayed by the liquid crystal display is also measured by the color analyzer. The ideal gamma curve 2 is obtained by calculating according to the following formula:

$$L_i=(L_{max}-L_{min})*(i/255)^{gamma}+L_{min}$$

Figure 3:
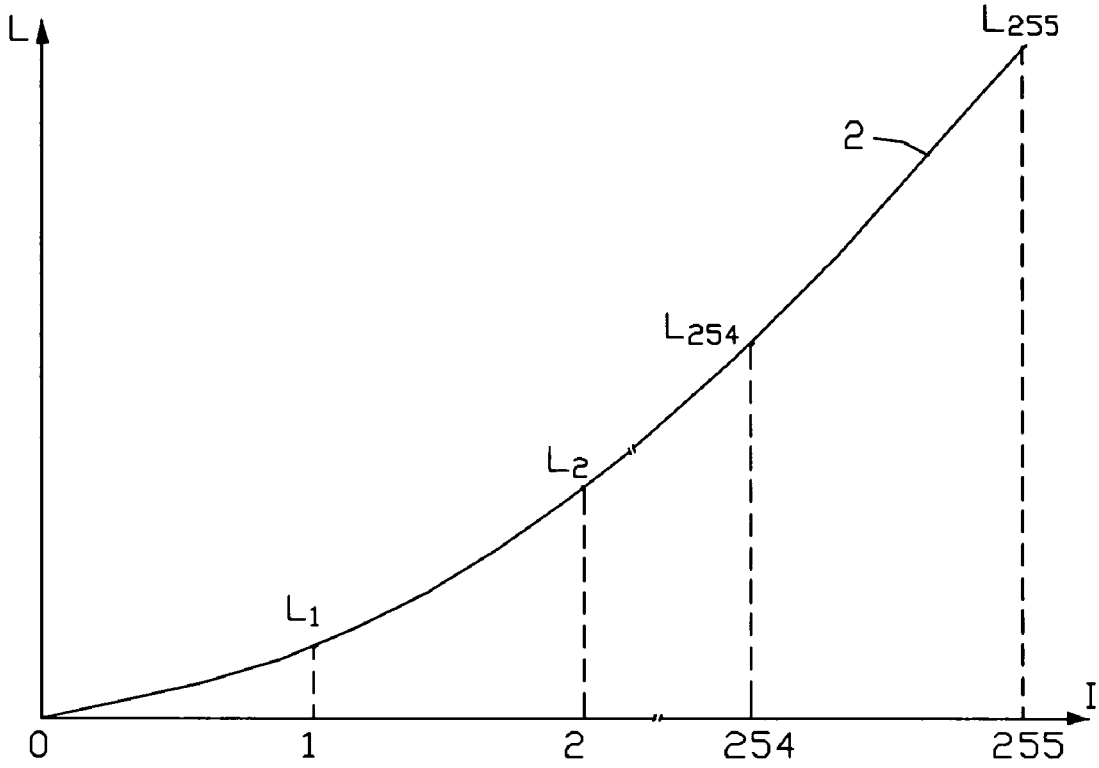
FIG. 3 is a graph illustrating an ideal relationship between gray scales (X-axis) and corresponding luminance values (Y-axis), showing an ideal gamma curve in accordance with the method of claim 1.
Figure 4:
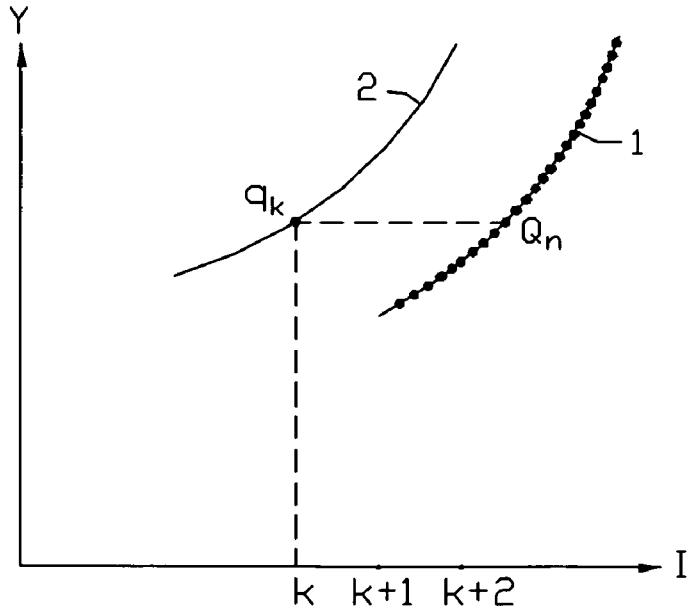
FIG. 4 is a graph illustrating relationships between gray scales (X-axis) and corresponding luminance values (Y-axis) using the red correction curve of FIG. 2 and the ideal gamma curve of FIG. 3, whereby a gamma correction table can be established.

The variable i is a whole number in the range from 0 to 255. When i is counted from 0 to 255, corresponding luminance values L0, L1,..., L254, L255 are calculated. Referring to FIG. 3, the ideal gamma curve 2 has horizontal coordinate values I representing different gray scales, and vertical coordinate values L representing corresponding luminance values.

In step S9, a gray scale k (where k is a whole number, and 0≦k=≦255) of the red image to be corrected is set.

In step S10, the gray scale k is corrected by the signal generator according to the red correction gamma table. The red correction curve 1 and the ideal gamma curve 2 are set together in a same coordinate plane. Horizontal coordinate values I represent the different gray scales from 0 to 255. Vertical coordinate values Y represent the corresponding luminance values. Points Q0 through Q1023 (1024 points in total) are sequentially arranged in the red correction curve 1, which points respectively correspond to the points A0 through A960 and the points P0 through P63. The points q0 through q255 respectively represent from gray scale 0 through gray scale 255 of the ideal gamma curve 2. A point Qn (0≦n≦1023) of the points Q0 through Q255 having a luminance value that is closest to the luminance value of the gray scale k (corresponding to the point qk) is selected, and the gray scale corresponding to the selected point Qn of the red correction curve 1 is stored in the register of the signal generator. Thus, the gray scale k is corrected.

In step S11, a next gray scale to be corrected is set. The next gray scale is gray scale (k+1).

In step S12, a counter of the signal generator determines whether all the gray scales from 0 through 255 have been corrected by the signal generator. If all the gray scales 0 through 255 have been corrected by the signal generator, the procedure goes to step S13. If not, the procedure goes back to step S10. Alternatively, instead of a counter, another suitable device embedded in the signal generator can make the determination.

In step S13, the gamma correction table is generated. The 256 gray scales stored in the signal generator are arranged in that order from smallest to largest, and these gray scales together constitute the red gamma correction table. Similarly to step S1 through step S12, a green gamma correction table and a blue gamma correction table can be generated. Then the gamma correction table is established by putting together the red, green, and blue gamma correction tables.

In step S14, the gamma correction table is burned into the memory of the liquid crystal display. When an image is displayed, the gamma correction table is applied for correcting the gray scales of the image.

An amount of the reference gray scales is not restricted to 64. For example, there can be 32 different reference gray scales or 128 different reference gray scales, or $2^n$ different reference gray scales ($1 \leqq 2^n \leqq 256$). When the amount of reference gray scales is 128, the reference gray scales respectively correspond to gray scales 0, 2, 4, . . . , 250, 252 of the image displayed.

When the amount of the reference gray scales is 32, a Bezier curve arithmetic interpolating calculation is adopted. Taking the color red as an example, a red correction curve can be obtained as follows. The reference gray scales respectively correspond to gray scales 0, 8, 16, . . . , 244, 252 of the color red. 32 points D0, D1, D2, . . . D30, D31 are provided to represent the 32 reference gray scales. The points D0 to D31 are located in a coordinate plane. The coordinate plane has a horizontal coordinate axis that represents the reference gray scales, and a vertical coordinate axis that represents the corresponding luminance values. The points D0, D1, and D2 are connected, thereby constituting a Bezier curve. The Bezier curve between the points D0 and D1 is divided into equal 32 parts by designating 31 interposing points. The points D1, D2, and D3 are connected, thereby constituting a Bezier curve. The Bezier curve between the points D1 and D2 is divided into equal 32 parts by designating 31 interposing points. Accordingly, every two adjacent points among the points D0 through D31 have 31 interposing points designated therebetween along a Bezier curve. In addition, beyond the point D32, 31 further points are also designated. For convenience, these 31 further points are also referred to as interposing points. A space between any two adjacent points among the points from the point D31 and beyond is the same as a space between any two adjacent points among the points between the points D30 and D31. Accordingly, there are a total of 1024 points, including the points from D0 through D31, and the interposing points between the points D0 and D31 and beyond the point D32. By connecting the 1024 points sequentially, the red correction curve is obtained.

In summary, in each of the above-described methods, a gamma correction table is generated by measuring some reference gray scales of red, green, and blue images, and calculating corresponding luminance values according to an arithmetic interpolating calculation. A liquid crystal display utilizing the method for establishing a gamma correction table can rapidly generating a gamma correction table to replace a predetermined gamma correction table, and thereby can correct the gray scales of images more precisely.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A method for establishing a gamma correction table, the method comprising:

providing a liquid crystal display, a signal generator, and a color analyzer, the liquid crystal display comprising a predetermined gamma correction table;

invalidating the predetermined gamma correction table of the liquid crystal display;

initializing the liquid crystal display, the signal generator, and the color analyzer;

measuring luminance values corresponding to $2^n$ reference gray scales of a single-colored image displayed by the liquid crystal display, wherein n is a natural number;

obtaining a single-colored correction curve relating to luminance values and corresponding gray scales using an arithmetic interpolating method, the $2^n$ reference gray scales, and measured luminance values, the arithmetic interpolating method comprising defining a first point for each of the reference gray scales in a coordinate plan, and dividing each curve between two adjacent first points into a plurality of equal parts by a plurality of second points;

obtaining an ideal single-colored gamma curve, and defining a plurality of points on the ideal single-colored gamma curve, each point being corresponding to a gray scale to be corrected, and the sum of the plurality of points are smaller than the sum of the first and second points;

selecting a gray scale corresponding to one of the points on the ideal single-colored gamma curve to be corrected, looking for a corresponding point from the first and second points on the single colored correction curve which has a luminance value closest to the luminance value corresponding to the gray scale to be corrected, and then storing the gray scale corresponding to the corresponding point, whereby the selected gray scale is corrected as the gray scale corresponding to the corresponding point;

correcting the gray scales corresponding to other points on the ideal single-colored gamma curve as the selected gray scale, and storing corrected gray scales;

establishing a single-color gamma correction table for the single color; and establishing a gamma correction table based on the single-color gamma correction table.

2. The method in claim 1, further comprising repeating the measuring of reference gray scales, obtaining of a single-colored correction curve, obtaining of an ideal single-colored gamma curve, storing of gray scales, and establishing of a gamma correction table for the single color to thereby obtain a plurality of single-color gamma correction tables each for a respective single color.

3. The method in claim 2, wherein the plurality of single-color gamma correction tables comprise a red gamma correction table, a green gamma correction table, and a blue gamma correction table, and said gamma correction table is established based on the red, green and blue gamma correction tables.

4. The method in claim 2, wherein the number n is equal to 6, and initializing the liquid crystal display, the signal generator, and the color analyzer comprises the signal generator providing a plurality of gamma voltages corresponding to a reference gray scale of 0 through a reference gray scale of 63 for each of the colors red, green, and blue.

5. The method in claim 4, wherein the reference gray scales 0 through 63 respectively correspond to gray scales of 0, 4, 8, . . . 248, 252 of the liquid crystal display.

6. The method in claim 2, wherein the number n is equal to 8, and initializing the liquid crystal display, the signal generator, and the color analyzer comprises the signal generator providing a plurality of gamma voltages corresponding to a reference gray scale of 0 through a reference gray scale of 127 for each of the colors red, green, and blue.

7. The method in claim 6, wherein the reference gray scales 0 to 127 respectively correspond to gray scales of 0, 2, 4, . . . 250, 252 of the liquid crystal display.

8. The method in claim 1, wherein invalidating a predetermined gamma correction table of the liquid crystal display is accomplished by one of an exterior circuit and an item of software.

9. The method in claim 1, wherein measuring $2^n$ (n is a natural number) reference gray scales of a single-colored image displayed by the liquid crystal display comprises selecting a reference gray scale from the range of $2^n$ reference gray scales, the signal generator generating the gamma voltage signal corresponding to the selected reference gray scale, the liquid crystal display displaying the image of the selected reference gray scale according to the gamma voltage signal, and measuring a single-colored image of the selected reference gray scale displayed by the liquid crystal display.

10. The method in claim 1, wherein the ideal gamma curve is obtained according to the formula $L_i=(L_{max}-L_{min})*(i/255)^{gamma}+L_{min}$ (i is a whole number, and $0 \leqq i \leqq 255$), $L_{max}$ and $L_{min}$ respectively representing a maximum value and a minimum value of the gray scales of the liquid crystal display.

11. The method in claim 1, further comprising burning said gamma correction table into the liquid crystal display.

12. A method for establishing a gamma correction table for a display system, the display system comprising a liquid crystal display, a signal generator, and a color analyzer, the method comprising:

measuring luminance values corresponding to $2^n$ reference gray scales of a single-colored image displayed by the liquid crystal display, wherein n is a natural number;

obtaining a single-colored correction curve relating to luminance values corresponding to gray scales using an arithmetic interpolating method, the $2^n$ reference gray scales, and measured luminance values, the arithmetic interpolating method comprising defining a first point for each of the reference gray scales in a coordinate plan, and dividing each curve between two adjacent first points into a plurality of equal parts by a plurality of second points;

obtaining an ideal single-colored gamma curve, and defining a plurality of points on the ideal single-colored gamma curve, each point being corresponding to a gray scale to be corrected, and the sum of the plurality of points are smaller than the sum of the first and second points;

selecting a gray scale corresponding to one of the points on the ideal single-colored gamma curve to be corrected, looking for a corresponding point from the first and second points on the single colored correction curve which has a luminance value closest to the luminance value corresponding to the gray scale to be corrected, and then storing the gray scale corresponding to the corresponding point, whereby the selected gray scale is corrected as the gray scale corresponding to the corresponding point;

correcting the gray scales corresponding to other points on the ideal single-colored gamma curve as the selected gray scale; and establishing a gamma correction table.

13. The method in claim 12, wherein the liquid crystal display comprises a predetermined gamma correction table, and the method further comprises:

invalidating the predetermined gamma correction table of the liquid crystal display.

14. The method in claim 12, wherein said gamma correction table comprises a red gamma correction table, a green gamma correction table, and a blue gamma correction table.

15. The method in claim 14, wherein the number n is equal to 6, and initializing the liquid crystal display, the signal generator, and the color analyzer comprises the signal generator providing a plurality of gamma voltages corresponding to a reference gray scale of 0 through a reference gray scale of 63 for each of the colors red, green, and blue.

16. The method in claim 12, wherein measuring $2^n$ (where n is a natural number) reference gray scales of a single-colored image displayed by the liquid crystal display comprises selecting a reference gray scale from the range of $2^n$ reference gray scales, the signal generator generating the gamma voltage signal corresponding to the selected reference gray scale, the liquid crystal display displaying the image of the selected reference gray scale according to the gamma voltage signal, and measuring a single-colored image of the selected reference gray scale displayed by the liquid crystal display.

17. The method in claim 12, wherein the ideal gamma curve is obtained according to the formula $L_i=(L_{max}-L_{min})*(i/255)^{gamma}+L_{min}$ (i is a whole number, and $0 \leqq i \leqq 255$), $L_{max}$ and $L_{min}$ respectively representing a maximum value and a minimum value of the gray scales of the liquid crystal display.

* * * * *